US007691793B2

(12) United States Patent
Muir

(10) Patent No.: US 7,691,793 B2
(45) Date of Patent: Apr. 6, 2010

(54) LUBRICANT ADDITIVE CONTAINING ALKYL HYDROXY CARBOXYLIC ACID BORON ESTERS

(75) Inventor: Ronald J. Muir, West Hill (CA)

(73) Assignee: Chemtura Corporation, Middlebury, CT (US)

( * ) Notice: Subject to any disclaimer, the term of this patent is extended or adjusted under 35 U.S.C. 154(b) by 1355 days.

(21) Appl. No.: 11/124,652

(22) Filed: May 9, 2005

(65) Prior Publication Data

US 2006/0019838 A1 Jan. 26, 2006

Related U.S. Application Data

(60) Provisional application No. 60/589,571, filed on Jul. 21, 2004.

(51) Int. Cl.
*C10M 145/10* (2006.01)
*C10M 125/01* (2006.01)

(52) U.S. Cl. ..... 508/186; 508/198; 508/199; 508/200

(58) Field of Classification Search ..... 508/198; 44/319

See application file for complete search history.

(56) References Cited

U.S. PATENT DOCUMENTS

| | | | | |
|---|---|---|---|---|
| 2,933,520 | A | 4/1960 | Bader | 260/476 |
| 3,038,935 | A | 6/1962 | Gerber et al. | 260/520 |
| 3,133,944 | A | 5/1964 | Christenson | 260/434 |
| 3,189,652 | A | 6/1965 | Pollitzer | |
| 3,239,463 | A | 3/1966 | Knowles, et al | |
| 3,446,808 | A | 5/1969 | Cyba | |
| 3,471,537 | A | 10/1969 | Berke et al. | 260/429 |
| 3,505,226 | A | 4/1970 | Cyba | |
| 3,673,186 | A | 6/1972 | Cyba | |
| 3,692,680 | A | 9/1972 | Cyba | |
| 3,787,416 | A | 1/1974 | Cyba | |
| 3,914,182 | A | 10/1975 | Ker et al. | |
| 4,474,670 | A | 10/1984 | Braid et al. | |
| 4,533,481 | A | 8/1985 | Jahnke | |
| 4,539,126 | A | 9/1985 | Bleeker et al. | |
| 4,741,848 | A | 5/1988 | Koch et al. | |
| 4,828,733 | A | 5/1989 | Farng et al. | 252/42.7 |
| 4,906,252 | A * | 3/1990 | Gutierrez et al. | 44/335 |
| 5,023,366 | A | 6/1991 | Yamaguchi et al. | 560/71 |
| 5,110,488 | A * | 5/1992 | Tipton et al. | 508/192 |
| 5,281,346 | A | 1/1994 | Adams et al. | 252/38 |
| 5,330,666 | A | 7/1994 | Habeeb | 252/34 |
| 5,336,278 | A | 8/1994 | Adams et al. | 44/419 |
| 5,356,546 | A | 10/1994 | Blystone et al. | 252/35 |
| 5,458,793 | A | 10/1995 | Adams et al. | 252/47 |
| 5,498,809 | A | 3/1996 | Emert et al. | 585/13 |
| 5,688,751 | A | 11/1997 | Cleveland et al. | 508/518 |
| 5,698,499 | A | 12/1997 | Baranski et al. | |
| 5,854,182 | A | 12/1998 | Swami et al. | 508/186 |
| 6,174,842 | B1 | 1/2001 | Gatto et al. | 508/364 |
| 6,200,936 | B1 | 3/2001 | Moreton | 508/479 |
| 6,268,320 | B1 | 7/2001 | Crawford | 508/572 |
| 6,310,011 | B1 | 10/2001 | Karn et al. | 508/460 |
| 6,339,052 | B1 | 1/2002 | Dohhen et al. | 508/436 |
| 6,355,074 | B1 | 3/2002 | Emert et al. | |
| 2003/0000866 | A1 * | 1/2003 | Cain | 208/18 |
| 2004/0038834 | A1 * | 2/2004 | Gahagan | 508/192 |
| 2006/0276350 | A1 | 12/2006 | Habeeb et al. | |
| 2006/0281643 | A1 | 12/2006 | Habeeb et al. | |

FOREIGN PATENT DOCUMENTS

| | | | |
|---|---|---|---|
| EP | 0949321 | A2 | 10/1999 |
| JP | 08165484 | A * | 6/1996 |
| WO | 2004/104106 | A1 | 12/2004 |
| WO | 2004/104146 | A1 | 12/2004 |
| WO | 2005/073352 | A1 | 8/2005 |
| WO | 2008/016485 | A1 | 2/2008 |

OTHER PUBLICATIONS

Lubrication and Lubricants, E.R. Braithwaite, Elsevier Publishing Co. (N. Y. 1967), pp. 166-196, Synthetic Lubricants.

Walker et al. Characterization of Lubrication Oils by Differential Scanning Calori: Tech Paper Series, 801383 (Oct. 20-23, 1980).

* cited by examiner

*Primary Examiner*—Glenn A Caldarola
*Assistant Examiner*—Taiwo Oladapo
(74) *Attorney, Agent, or Firm*—Katten Muchin Rosenman LLP

(57) ABSTRACT

A composition is disclosed that comprises the reaction product of an acidic organic compound and a boron compound. The composition is useful as a detergent additive for lubricants and hydrocarbon fuels.

12 Claims, No Drawings

LUBRICANT ADDITIVE CONTAINING ALKYL HYDROXY CARBOXYLIC ACID BORON ESTERS

I claim the benefit under Title 35, United States Code, §120 of U.S. Provisional Application No. 60/589,571, filed Jul. 21, 2004, entitled FUEL AND LUBRICANT ADDITIVE CONTAINING ALKYL HYDROXY CARBOXYLIC ACID BORON ESTERS.

BACKGROUND OF THE INVENTION

1. Field of the Invention

This invention is related to fuels, especially hydrocarbon fuels, and lubricants, especially lubricating oils, and, more particularly, to a class of anti-oxidant additives having good lubricity, detergency, and rust protection that are the reaction products of acidic organic compounds, such as hydrocarbyl salicylic acids and esters thereof with boron compounds, such as boric acid.

2. Description of Related Art

Metal detergents represent a major source of ash in formulated engine oils. Alkaline earth sulfonates, phenates and salicylates are typically used in modern engine oils to provide detergency and alkaline reserve. Detergents are necessary components of engine oils for both gasoline and diesel engines. Incomplete combustion of the fuel produces soot that can lead to sludge deposits as well as carbon and varnish deposits. In the case of diesel fuel, residual sulfur in the fuel burns in the combustion chamber to produce sulfur derived acids. These acids produce corrosion and corrosive wear in the engine, and they also accelerate the degradation of the oil. Neutral and overbased detergents are introduced into engine oils to neutralize these acidic compounds preventing formation of harmful engine deposits and dramatically increasing engine life.

U.S. Pat. No. 5,330,666 discloses a lubricant oil composition useful for reducing friction in an internal combustion engine which comprises a lubricating oil basestock and an alkoxylated amine salt of a hydrocarbylsalicylic acid of a defined formula.

U.S. Pat. No. 5,688,751 discloses that two-stroke cycle engines can be effectively lubricated by supplying to the engine a mixture of an oil of lubricating viscosity and a hydrocarbyl-substituted hydroxyaromatic carboxylic acid or an ester, unsubstituted amide, hydrocarbyl-substituted amide, ammonium salt, hydrocarbylamine salt, or monovalent metal salt thereof in an amount suitable to reduce piston deposits in said engine. The mixture supplied to the engine contains less than 0.06 percent by weight of divalent metals.

U.S. Pat. No. 5,854,182 discloses the preparation of magnesium borate overbased metallic detergent having magnesium borate uniformally dispersed in an extremely fine particle size by using magnesium alkoxide and boric acid. The preparation involves reacting a neutral sulphonate of an alkaline earth metal with magnesium alkoxide and boric acid under anhydrous conditions in the presence of a dilution solvent followed by distillation to remove alcohol and part of dilution solvent therefrom. The borated mixture is then cooled, filtered to recover magnesium borated metal detergent, which is said to exhibit excellent cleaning and dispersing performance, very good hydrolytic and oxidation stability, and good extreme pressure and antiwear properties.

U.S. Pat. No. 6,174,842 discloses a lubricating oil composition that contains from about 50 to 1000 parts per million of molybdenum from a molybdenum compound that is oil-soluble and substantially free of reactive sulfur, about 1,000 to 20,000 parts per million of a diarylamine, and about 2,000 to 40,000 parts per million of a phenate. This combination of ingredients is said to provide improved oxidation control and improved deposit control to the lubricating oil.

U.S. Pat. No. 6,339,052 discloses a lubricating oil composition for gasoline and diesel internal combustion engines includes a major portion of an oil of lubricating viscosity; from 0.1 to 20.0% w/w of a component A, which is a sulfurized, overbased calcium phenate detergent derived from distilled, hydrogenated cashew nut shell liquid; and from 0.1 to 10.0% w/w of a component B, which is an amine salt of phosphorodithioic acid of a specified formula derived from cashew nut shell liquid.

Provisional Appln. Ser. No. 60/539,590, filed Jan. 29, 2004, discloses a composition comprising the reaction product of an acidic organic compound, a boron compound, and a basic organic compound.

SUMMARY OF THE INVENTION

According to the present invention, metal-free detergents and anti-oxidants are prepared by reacting an acidic organic compound and a boron compound.

More specifically, a lubricant additive with good lubricity, detergency, rust protection and antioxidant properties is prepared by first alkylating salicylic acid with, preferably, an olefin having at least six carbon atoms to produce an alkyl salicylic acid. The alkyl salicylic acid is reacted with boric acid to produce a reaction product with good fuel and lubricant solubility with the above mentioned properties.

Preferably, the acidic organic compound is selected from the group consisting of alkyl substituted salicylic acids, disubstituted salicylic acids, oil soluble hydroxy carboxylic acids, salicylic acid calixarenes, sulfur-containing calixarenes, and the acidic structures disclosed in U.S. Pat. Nos. 2,933,520; 3,038,935; 3,133,944; 3,471,537; 4,828,733; 6,310,011; 5,281,346; 5,336,278; 5,356,546; and 5,458,793.

The boron compound can, for example, be boric acid, a trialkyl borate in which the alkyl groups preferably comprise from 1 to 4 carbon atoms each, alkyl boric acid, dialkyl boric acid, boric oxide, boric acid complex, cycloalkyl boric acid, aryl boric acid, dicycloalkyl boric acid, diaryl boric acid, or substitution products of these with alkoxy, alkyl, and/or alkyl groups, and the like.

The reaction product provides excellent detergency and cleanliness to an oil when evaluated using the panel coker test and excellent antioxidant performance when evaluated using pressure differential scanning calorimetry (PDSC).

More particularly, the present invention is directed to a composition comprising the reaction product of an acidic organic compound and a boron compound.

In another aspect, the present invention is directed to a composition comprising:

(A) a lubricant, and (B) at least one reaction product of an acidic organic compound and a boron compound.

In still another aspect, the present invention is directed to a composition comprising:

(A) a hydrocarbon fuel, and (B) at least one reaction product of an acidic organic compound and a boron compound.

In yet another aspect, the present invention is directed to a method for reducing friction in an internal combustion engine which comprises operating the engine with a lubricating oil containing an amount effective to reduce friction of the reaction product of an acidic organic compound and a boron compound.

DESCRIPTION OF THE PREFERRED EMBODIMENTS

This invention relates to lubricant compositions comprising an additive comprising boron, which provides improved detergency and oxidation stability in an internal combustion engine oil. The lubricant composition comprises (a) a major amount of a lubricant, e.g., lubricating oil and (b) a minor amount of an additive that is the reaction product of an acidic organic compound and a boron compound.

The Acidic Organic Compounds

The acidic organic compounds employed in the practice of the present invention include, but are not limited to, alkyl substituted salicylic acids, di-substituted salicylic acids, oil soluble hydroxy carboxylic acids, salicylic acid calixarenes, sulfur-containing calixarenes, and the acidic structures disclosed in U.S. Pat. Nos. 2,933,520; 3,038,935; 3,133,944; 3,471,537; 4,828,733; 6,310,011; 5,281,346; 5,336,278; 5,356,546; and 5,458,793.

The substituted salicylic acids employed in the practice of the present invention are commercially available or may be prepared by methods known in the art, e.g., U.S. Pat. No. 5,023,366. These salicylic acids are of the formula:

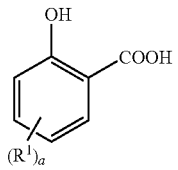

wherein $R^1$ is a hydrocarbyl group, preferably of from 1 to 30 carbon atoms, and a is an integer of 1 or 2. Where a is 2, the $R^1$ groups are independently selected, i.e., they may be the same or different.

As employed herein, the term "hydrocarbyl" includes hydrocarbon as well as substantially hydrocarbon groups. "Substantially hydrocarbon" describes groups that contain heteroatom substituents that do not alter the predominantly hydrocarbon nature of the group.

Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic substituents, aromatic-, aliphatic-, and alicyclic-substituted aromatic substituents, and the like, as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo, hydroxy, mercapto, nitro, nitroso, sulfoxy, etc.);

(3) heteroatom substituents, i.e., substituents that will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen, and such substituents as, e.g., pyridyl, furyl, thienyl, imidazolyl, etc. Preferably, no more than about 2, more preferably no more than one, hetero substituent will be present for every ten carbon atoms in the hydrocarbyl group. Most preferably, there will be no such heteroatom substituents in the hydrocarbyl group, i.e., the hydrocarbyl group is purely hydrocarbon.

In the formula described above, $R^1$ is hydrocarbyl. Examples of $R^1$ include, but are not limited to, unsubstituted phenyl;

phenyl substituted with one or more alkyl groups, such as methyl, ethyl, propyl, butyl, pentyl, hexyl, heptyl, octyl, nonyl, decyl, isomers of the foregoing, and the like;

phenyl substituted with one or more alkoxy groups, such as methoxy, ethoxy, propoxy, butoxy, pentoxy, hexoxy, heptoxy, octoxy, nonoxy, decoxy, isomers of the foregoing, and the like;

phenyl substituted with one or more alkyl amino or aryl amino groups;

naphthyl and alkyl substituted naphthyl;

straight chain or branched chain alkyl or alkenyl groups containing from one to fifty carbon atoms, including, but not limited to, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, isomers of the foregoing, and the like; and cyclic alkyl groups, such as cyclopentyl, cyclohexyl, cycloheptyl, cyclooctyl, and cyclododecyl.

It will be noted that these salicylic acid derivatives can be either monosubstituted or disubstituted, i.e., when a in the formula equals 1 or 2, respectively.

Salicylic acid calixarenes, for example those described in U.S. Pat. No. 6,200,936, the disclosure of which is incorporated herein by reference in its entirety, can be used as the acid compounds of the present invention. Such calixarenes include, but are not limited to, cyclic compounds comprising m units of formula (Ia):

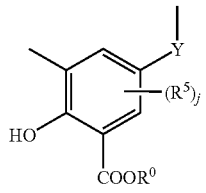

and n units of formula (Ib):

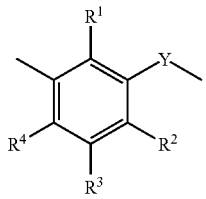

joined together to form a ring, wherein each Y is a divalent bridging group which may be the same or different in each unit; $R^0$ is H or an alkyl group of 1 to 6 carbon atoms; $R^5$ is H or an alkyl group of 1 to 60 carbon atoms; and j is 1 or 2; $R^3$ is hydrogen, a hydrocarbyl or a hetero-substituted hydrocarbyl group; either $R^1$ is hydroxy and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; m is from 1 to 8; n is at least 3, and m+n is 4 to 20.

When more than one salicylic acid unit is present in the ring (i.e., m>1), the salicylic acid units (formula (Ia)) and phenol units (formula (Ib)) are distributed randomly, although this does not exclude the possibility that in some rings there may be several salicylic acid units joined together in a row.

Each Y may independently be represented by the formula $(CHR^6)_d$ in which $R^6$ is either hydrogen or hydrocarbyl and d is an integer which is at least 1. In one embodiment, $R^6$ contains 1 to 6 carbon atoms, and in one embodiment it is methyl. In one embodiment, d is from 1 to 4. Y may optionally be sulfur rather than $(CHR^6)_d$ in up to 50% of the units, such that the amount of sulfur incorporated in the molecule is up to 50 mole %. In one embodiment, the amount of sulfur is between 8 and 20 mole %, and in one embodiment the compound is sulfur-free.

For convenience, these compounds are sometimes referred to as "salixarenes" and their metal salts as "salixarates".

In one embodiment, Y is $CH_2$; $R^1$ is hydroxyl; $R^2$ and $R^4$ are independently either hydrogen, hydrocarbyl or hetero-substituted hydrocarbyl; $R^3$ is either hydrocarbyl or hetero-substituted hydrocarbyl; $R^0$ is H; $R^5$ is an alkyl group of 6 to 50 carbon atoms, preferably 4 to 40 carbon atoms, more preferably 6 to 25 carbon atoms; and m+n has a value of at least 5, preferably at least 6, more preferably at least 8, where m is 1 or 2. Preferably, m is 1.

In another embodiment, $R^2$ and $R^4$ are hydrogen; $R^3$ is hydrocarbyl, preferably alkyl of greater than 4 carbon atoms, more preferably greater than 9 carbon atoms; $R^5$ is hydrogen; m+n is from 6 to 12; and m is 1 or 2.

For a review of calixarenes, see *Monographs in Supramolecular Chemistry* by C. David Gutsche, Series Editor-J. Fraser Stoddart, published by the Royal Society of Chemistry, 1989. Calixarenes having a substituent hydroxyl group or groups include homocalixarenes, oxacalixarenes, homooxacalixarenes, and heterocalixarenes.

Sulfur-containing calixarenes, for example those described in U.S. Pat. No. 6,268,320, the disclosure of which is incorporated herein by reference in its entirety, can also be used as the acid compounds of the present invention. Such calixarenes include, but are not limited to, compounds represented by formula (II):

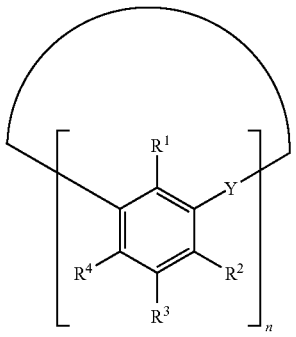

wherein in formula (II): Y is a divalent bridging group, at least one of said bridging groups being a sulfur atom; $R^3$ is hydrogen or a hydrocarbyl group; either $R^1$ is hydroxyl and $R^2$ and $R^4$ are independently either hydrogen or hydrocarbyl, or $R^2$ and $R^4$ are hydroxyl and $R^1$ is either hydrogen or hydrocarbyl; and n is a number having a value of at least 4.

In formula (II), Y is a divalent bridging group or a sulfur atom with the proviso that at least one Y group is a sulfur atom. The divalent bridging group, when not a sulfur atom, can be a divalent hydrocarbon group or divalent hetero-substituted hydrocarbon group of 1 to 18 carbon atoms, and in a preferred embodiment, 1 to 6 carbon atoms. The heteroatoms can be —O—, —NH—, or —S—. n is an integer that typically has a value of at least 4, preferably from 4 to 12, more preferably, 4 to 8. In one embodiment, n−2 to n−6 of the Y groups are sulfur atoms, in another embodiment n−3 to n−10 of the Y groups are sulfur atoms, and in a third embodiment, one of the Y groups is a sulfur atom. Preferably, the amount of sulfur incorporated in the calixarene is between 5 and 50 mole %, such that between 5 and 50% of the groups Y in formula (II) are sulfur atoms. More preferably, the amount of sulfur is between 8 and 20 mole %.

In one embodiment, when Y is not a sulfur atom it is a divalent group represented by the formula $(CHR^6)_d$ in which $R^6$ is either hydrogen or a hydrocarbyl group and d is an integer that is at least one. $R^6$ is preferably a hydrocarbyl group of 1 to 18 carbon atoms, more preferably, 1 to 6 carbon atoms. Examples include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, isomers or the foregoing, and the like. Preferably, d is from 1 to 3, more preferably 1 to 2, and most preferably, d is 1. As defined above, the term "hydrocarbyl groups" includes hetero-substituted hydrocarbyl groups, and are preferably those in which the heteroatom, typically —O—, —NH—, or —S—, interrupts a chain of carbon atoms, an example being an alkoxy-alkyl group of 2 to 20 carbons.

$R^3$ is hydrogen or a hydrocarbyl group, which may be derived from a polyolefin, for example polyethylene, polypropylene, polybutylene, or polyisobutylene, or a polyolefin copolymer, for example an ethylene/propylene copolymer. Examples of $R^3$ include dodecyl and octadecyl. Heteroatoms, if present, can again be —O—, —NH—, or —S—. These hydrocarbyl groups preferably have 1 to 20 carbon atoms, more preferably, 1 to 6 carbon atoms.

Either $R^1$ is hydroxyl and $R^2$ and $R^4$ are independently either hydrogen or hydrocarbyl, or $R^2$ and $R^4$ are hydroxyl and $R^1$ is either hydrogen or hydrocarbyl. In one embodiment, $R^1$ is hydrogen, $R^2$ and $R^4$ are hydroxyl, and $R^3$ is either hydrogen or hydrocarbyl in the formula (II) and the calixarene is a resorcinarene. The hydrocarbyl groups preferably have 1 to 24 carbon atoms, more preferably 1 to 12 carbon atoms. The heteroatoms, when present, can be —O—, —NH—, or —S—.

In one embodiment, Y is either sulfur or $(CR^7R^8)_e$, where either one of $R^7$ and $R^8$ is hydrogen and the other is hydrogen or hydrocarbyl; $R^2$ and $R^4$ are independently either hydrogen or hydrocarbyl, $R^3$ is hydrocarbyl; n is 6; and e is at least 1, preferably 1 to 4, more preferably, 1. Preferably, $R^2$ and $R^4$ are hydrogen and $R^3$ is hydrocarbyl, preferably alkyl of greater than 4, more preferably greater than 9, most preferably greater than 12 carbon atoms; and one of $R^7$ or $R^8$ is hydrogen and the other is either hydrogen or alkyl, preferably hydrogen.

The foregoing sulfur-containing calixarenes typically have a molecular weight below 1880. Preferably, the molecular weight of the sulfur-containing calixarene is from 460 to 1870, more preferably from 460 to 1800, most preferably 460 to 1750.

Acids described in U.S. Pat. Nos. 2,933,520; 3,038,935; 3,133,944; 3,471,537; 4,828,733; 5,281,346; 5,336,278; 5,356,546; 5,458,793; and 6,310,011, the disclosures of which are incorporated herein by reference in their entirety, can also be used as the acid compounds of the present invention.

More specifically, such acids include, but are not limited to, compounds of the formula:

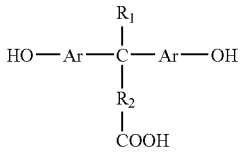

wherein $R_1$ is hydrocarbon or halogen, $R_2$ is hydrocarbon, Ar is substituted or unsubstituted aryl. Useful compounds similar to these include 3,5,3',5'-tetra-substituted 4,4'-dihydroxymethyl carboxylic acids, acids of the formula

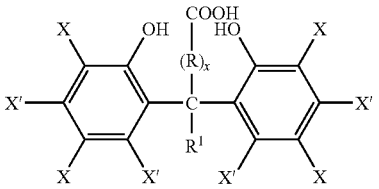

wherein X and X' are independently selected from the group consisting of hydrogen, hydrocarbyl, halogen, R is polymethylene or branched or unbranched alkylene, and x is 0 or 1, i.e., when x is zero, R is absent, and when x is 1, R is present, and $R^1$ is hydrogen or hydrocarbyl.

The acids and salts described in U.S. Pat. Nos. 5,281,346; 5,336,278; 5,356,546; 5,458,793; and 6,310,011 are similar to the above and are also contemplated for use in the practice of the present invention, as are those of the formula

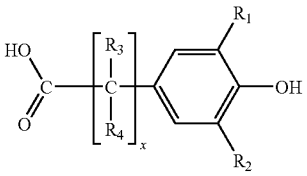

wherein $R_1$ and $R_2$ are hydrogen, hydrocarbyl groups containing 1 to 18 carbon atoms, or tertiary alkyl or arylalkyl groups containing 4 to 8 carbon atoms (but both $R_1$ and $R_2$ cannot be hydrogen) $R_3$ and $R_4$ are independently selected from the group consisting of hydrogen, hydrocarbyl groups, arylalkyl groups, and cycloalkyl groups, and x=0 to 24.

Oil soluble hydroxy carboxylic acids including, but not limited to, 12-hydroxy stearic acid, alpha hydroxy carboxylic acids and the like can also be employed as the acidic compound of the present invention.

The Boron Compounds

The boron compound can, for example, be boric acid, a trialkyl borate in which the alkyl groups preferably comprise from 1 to 4 carbon atoms each, alkyl boric acid, dialkyl boric acid, boric oxide, boric acid complex, cycloalkyl boric acid, aryl boric acid, dicycloalkyl boric acid, diaryl boric acid, or substitution products of these with alkoxy, alkyl, and/or alkyl groups, and the like. Boric acid is preferred.

The reaction of the boron compound with the acidic compounds of the present invention can be effected in any suitable manner.

In one method the acidic compound and boron compound are refluxed in the presence of suitable solvents including naphtha and polar solvents, such as water and methanol. After sufficient time the boron compound dissolves. Diluting oil can be added as needed to control viscosity, particularly during removal of solvents by distillation.

An alcohol, including aliphatic and aromatic alcohols, or a mercaptan, including aliphatic and aromatic mercaptans, can be included in the reaction charge. Preferred aliphatic alcohols include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, isomers thereof, and the like. Preferred aromatic alcohols include phenol, cresol, xylenol, and the like. The alcohol or aromatic phenol moiety may be substituted with alkoxy groups or thioalkoxy groups. Preferred mercaptans include butyl mercaptan, pentyl mercaptan, hexyl mercaptan, heptyl mercaptan, octyl mercaptan, nonyl mercaptan, decyl mercaptan, undecyl mercaptan, dodecyl mercaptan, and the like, as well as thiophenol, thiocresol, thioxylenol, and the like.

The precise structures of the detergent/anti-oxidant additives of the present invention are not fully understood. However, in one preferred embodiment, in which a $C_{16}$ alkyl salicylic acid was reacted with boric acid, mass spectrometric analysis indicated that the structure of the reaction product was:

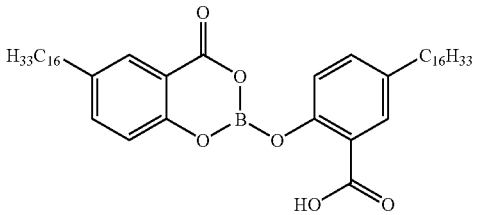

Those skilled in the art will thus understand that the foregoing leads to the following generalized structural formula for this particular aspect of the present invention:

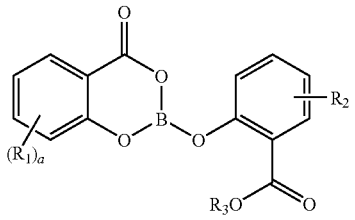

wherein $R_1$ is preferably a hydrocarbyl group, preferably alkyl, of, preferably, from 1 to 50 carbon atoms; a is an integer of 1 or 2 (where a is 2, the $R_1$ groups are independently selected, i.e., they may be the same or different); $R_2$ is an independently selected hydrocarbyl group, preferably alkyl, preferably of from 1 to 50 carbon atoms; and $R_3$ is hydrogen or alkyl, preferably of from 1 to 6 carbon atoms.

Clearly, the use of alternative starting materials, as described above, will lead to different, but analogous, structures that are within the scope of the present invention.

The additives of the present invention are especially useful as components in many different lubricating oil and fuel compositions. The additives can be included in a variety of oils with lubricating viscosity including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

It is preferred that the compositions of the present invention be included in the oil, fuel, or grease in a concentration in the range of from about 0.01 to about 15 wt %.

Use with Other Additives

The additives of this invention can be used as a partial replacement for a detergent currently used. They can also be used in combination with other lubricant additives typically found in fuels and motor oils, such as detergents, dispersants, anti-wear agents, extreme pressure agents, corrosion/rust inhibitors, antioxidants, anti-foamants, friction modifiers, seal swell agents, demulsifiers, Viscosity Index (VI) improvers, metal passivators, and pour point depressants. See, for example, U.S. Pat. No. 5,498,809 for a description of useful lubricating oil composition additives, the disclosure of which is incorporated herein by reference in its entirety.

Examples of dispersants include polyisobutylene succinimides, polyisobutylene succinate esters, Mannich Base ashless dispersants, and the like. Examples of detergents include neutral and overbased alkali and alkaline earth metal salts of sulfonic acids carboxylic acids, alkyl phenates and alkyl salicylic acids.

Examples of antioxidants include alkylated diphenylamines, N-alkylated phenylenediamines, phenyl-α-naphthylamine, alkylated phenyl-α-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like. The following are exemplary of such additives and are commercially available from Crompton Corporation: Naugalube® 438, Naugalube 438L, Naugalube 640, Naugalube 635, Naugalube 680, Naugalube AMS, Naugalube APAN, Naugard PANA, Naugalube TMQ, Naugalube 531, Naugalube 431, Naugard® BHT, Naugalube 403, and Naugalube 420, among others.

Examples of anti-wear additives that can be used in combination with the additives of the present invention include organo-borates, organo-phosphites, organo-phosphates, organic sulfur-containing compounds, sulfurized olefins, sulfurized fatty acid derivatives (esters), chlorinated paraffins, zinc dialkyldithiophosphates, zinc diaryldithiophosphates, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. The following are exemplary of such additives and are commercially available from R.T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K.K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others.

An example of an anti-foamant is polysiloxane, and the like. Examples of rust inhibitors are polyoxyalkylene polyol, benzotriazole derivatives, and the like. Examples of VI improvers include olefin copolymers and dispersant olefin copolymers, and the like. An example of a pour point depressant is polymethacrylate, and the like.

Lubricant Compositions

Compositions, when they contain these additives, are typically blended into a base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1-12 | 1-4 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, vegetable oils (e.g., canola oils, castor oils, sunflower oils), petroleum oils, mineral oils, and oils derived from coal or shale.

Many synthetic lubricants are known in the art and these are useful as a base lubricating oil for lubricating compositions containing the subject additives. Surveys of synthetic lubricants are contained in the publications, SYNTHETIC LUBRICANTS by R. C. Gunderson and A. W. Hart, published by Reinhold (N.Y., 1962), LUBRICATION AND LUBRICANTS, E. R. Braithwaite, ed., published by Elsevier Publishing Co., (N.Y., 1967), Chapter 4, pages 166 through 196, "Synthetic Lubricants", and SYNTHETIC LUBRICANTS by M. W. Ranney, published by Noyes Data Corp., (Park Ridge, N.J., 1972). These publications are incorporated herein by reference to establish the state of the art in regard to identifying both general and specific types of synthetic lubricants which can be used in conjunction with the additives of the present invention.

Thus, useful synthetic lubricating base oils include hydrocarbon oils derived from the polymerization or copolymerization of olefins, such as polypropylene, polyisobutylene and propylene-isobutylene copolymers; and the halohydrocarbon oils, such as chlorinated polybutylene. Other useful synthetic base oils include those based upon alkyl benzenes, such as dodecylbenzene, tetra-decylbenzene, and those based upon polyphenyls, such as biphenyls and terphenyls.

Another known class of synthetic oils useful as base oils for the subject lubricant compositions are those based upon alkylene oxide polymers and interpolymers, and those oils obtained by the modification of the terminal hydroxy groups of these polymers, (i.e., by the esterification or etherification of the hydroxy groups). Thus, useful base oils are obtained from polymerized ethylene oxide or propylene oxide or from the copolymers of ethylene oxide and propylene oxide. Useful oils include the alkyl and aryl ethers of the polymerized alkylene oxides, such as methylpolyisopropylene glycol ether, diphenyl ether of polyethylene glycol and diethyl ether of propylene glycol. Another useful series of synthetic base oils is derived from the esterification of the terminal hydroxy group of the polymerized alkylene oxides with mono- or polycarboxylic acids. Exemplary of this series are the acetic acid esters or mixed $C_3$-$C_8$ fatty acid esters of the $C_{13}$ oxo acid diester of tetraethylene glycol.

Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Other esters useful as synthetic oils include those made from copolymers of α-olefins and dicarboxylic acids which are esterified with short or medium chain length alcohols. The following are exemplary of such additives and are commercially available from Akzo Nobel Chemicals SpA: Ketjenlubes 115, 135, 165, 1300, 2300, 2700, 305, 445, 502, 522, and 6300, among others.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The advantages and the important features of the present invention will be more apparent from the following examples.

EXAMPLES

Detergency Performance

Panel Coker Test

The detergency efficacy of crankcase oils can be assessed in terms of deposit forming tendency on a rectangular Al-steel panel in a Panel Coker test. In this test, 200 ml of the test sample is taken in sump and heated at 100° C. For a period of 6 hours, this heated oil is splashed by whiskers on the Al-steel panel, the temperature of which is maintained at 310° C. After completion of the test, any deposits on the panel are weighed. A decrease in the weight of deposits as compared with a similar composition lacking the detergent additive indicates improved detergency.

Antioxidant Performance

Pressure Differential Scanning Calorimetry (PDSC)

PDSC (DuPont Model-910/1090B) can be used for relative antioxidant performance evaluation of the composition. In this method, a test sample (10 mg) taken in a sample boat is subjected to heating from 100-300° C. at the rate of 10° C. per minute under 500 psi oxygen pressure. The onset of oxidation temperature is adopted as a criterion for assessment of antioxidant performance. In general, an increase in onset of oxidation temperature indicates improvement in antioxidant performance. See J. A. Walker and W. Tsang, "Characterization of Lubrication Oils by Differential Scanning Calorimetry", SAE Technical Paper Series, 801383 (Oct. 20-23, 1980).

Example 1

207 grams of salicylic acid was added to a three-necked flask equipped with a thermometer, a stirrer, and a source of nitrogen to blanket the reaction vessel. Next, 354 grams of a $C_{16}$ alpha olefin was added followed by 43.5 grams of methane sulfonic acid. The mixture was heated to 120° C. under the nitrogen blanket for 24 hours at which time the catalyst was removed. The product had an acid value of 143 milliequivalents of KOH/gram and a yield of about 90% alkyl salicylic acid.

Example 2

41 grams of the alkyl salicylic acid from Example 1 was added to a three-necked flask equipped with a stirrer and a thermometer. This was followed by the addition of 30 grams of methanol, 15 grams of water, 40 grams of solvent refined base oil, and 50 grams of naphtha. The mixture was heated to 30° C. and 15 grams of boric acid was added. Over the next 2 hours, the mixture was heated to 215° C. to remove solvents. The resulting product was clear and fluid and had an acid value of 82.8 milliequivalents of KOH/gram of sample.

Testing:

A) The product of Example 2 was evaluated in a panel coker test to assess the deposit forming tendency of an oil treated with 5 wt % of material. At the end of the test, 1.2 milligrams of deposit was found, whereas an SAE 50 base oil evaluated without additives produced more than 150 milligrams of deposit.

B) The alkyl salicylic acid of Example 1 was also evaluated in the panel coker test and produced 191.1 milligrams of deposit C) ASTM D-6079 was used to evaluate the product of Example 1 for lubricity performance in a low sulfur diesel fuel containing about 13 ppm sulfur. Testing was done at 150 ppm of the acid of Example 1 in a low sulfur fuel and resulted in a wear scar diameter of 412 μm. The product's performance was similar to tall oil fatty acid, which had a wear scar of 415 μm and was superior to non-additized diesel fuel, which produced a wear scar of 610 μm.

D) Example 2 was tested in an ASTM D665 rust test and its performance compared to a commercial calcium dinonyl naphthalene sulfonate (Nasul 729 from King Industry). At a treat of 0.75% in oil, the boron ester passed 48 hours while the commercial sulfonate failed the test with numerous rust spots.

In view of the many changes and modifications that can be made without departing from principles underlying the invention, reference should be made to the appended claims for an understanding of the scope of the protection to be afforded the invention.

What is claimed is:

1. A composition comprising:

(A) a lubricant, and (B) at least one reaction product of an acidic organic compound and a boron compound, wherein the at least one reaction product is of the structure:

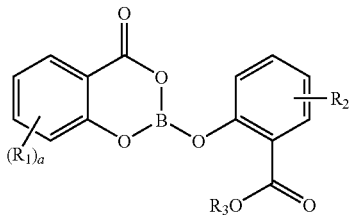

wherein $R_1$ is a hydrocarbyl group; a is an integer of 1 or 2, wherein if a is 2, the $R_1$ groups are independently selected; $R_2$ is an independently selected hydrocarbyl group; and $R_3$ is hydrogen or alkyl.

2. The composition of claim 1 wherein the acidic organic compound is selected from the group consisting of alkyl substituted salicylic acids, and di-substituted salicylic acids.

3. The composition of claim 1 wherein the boron compound is selected from the group consisting of boric acid, a trialkyl borate, alkyl boric acid, dialkyl boric acid, boric oxide, boric acid complex, cycloalkyl boric acid, aryl boric acid, dicycloalkyl boric acid, diaryl boric acid, and substitution products of these with alkoxy, alkyl, and/or alkyl groups.

4. The composition of claim 3 wherein the boron compound is boric acid.

5. The composition of claim 1 wherein the lubricant is a lubricating oil.

6. The composition of claim 5 wherein the acidic organic compound is selected from the group consisting of alkyl substituted salicylic acids, and di-substituted salicylic acids.

7. The composition of claim 5 wherein the boron compound is selected from the group consisting of boric acid, a trialkyl borate, alkyl boric acid, dialkyl boric acid, boric oxide, boric acid complex, cycloalkyl boric acid, aryl boric acid, dicycloalkyl boric acid, diaryl boric acid, and substitution products of these with alkoxy, alkyl, and/or alkyl groups.

8. The composition of claim 7 wherein the boron compound is boric acid.

9. A method for reducing friction in an internal combustion engine which comprises operating the engine with a lubricating oil containing an amount effective to reduce friction of the reaction product of an acidic organic compound and a boron compound, wherein the at least one reaction product is of the structure:

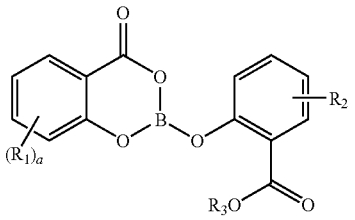

wherein $R_1$ is a hydrocarbyl group; a is an integer of 1 or 2, wherein if a is 2, the $R_1$ groups are independently selected; $R_2$ is an independently selected hydrocarbyl group; and $R_3$ is hydrogen or alkyl.

10. The method of claim 9 wherein the acidic organic compound is selected from the group consisting of alkyl substituted salicylic acids, and di-substituted salicylic acids.

11. The method of claim 9 wherein the boron compound is selected from the group consisting of boric acid, a trialkyl borate, alkyl boric acid, dialkyl boric acid, boric oxide, boric acid complex, cycloalkyl boric acid, aryl boric acid, dicycloalkyl boric acid, diaryl boric acid, and substitution products of these with alkoxy, alkyl, and/or alkyl groups.

12. The method of claim 11 wherein the boron compound is boric acid.

* * * * *